US008839731B2

(12) United States Patent
Rezzonico

(10) Patent No.: US 8,839,731 B2
(45) Date of Patent: Sep. 23, 2014

(54) FENDER FOR A BOAT, IN STEEL WITH PVC CORE

(75) Inventor: Ranieri Rezzonico, Capiago (IT)

(73) Assignee: Tessilmare s.r.l., Asso (CO) (IT)

( * ) Notice: Subject to any disclaimer, the term of this patent is extended or adjusted under 35 U.S.C. 154(b) by 314 days.

(21) Appl. No.: 13/139,798

(22) PCT Filed: Mar. 23, 2009

(86) PCT No.: PCT/EP2009/053389

§ 371 (c)(1),
(2), (4) Date: Jun. 15, 2011

(87) PCT Pub. No.: WO2010/069609

PCT Pub. Date: Jun. 24, 2010

(65) Prior Publication Data

US 2011/0247540 A1 Oct. 13, 2011

(30) Foreign Application Priority Data

Dec. 17, 2008 (IT) ..... MI2008A2244

(51) Int. Cl.
*B63B 59/02* (2006.01)

(52) U.S. Cl.
CPC ..... *B63B 59/02* (2013.01)
USPC ..... 114/219

(58) Field of Classification Search
USPC ..... 114/219, 220; 296/124, 128
See application file for complete search history.

(56) References Cited

U.S. PATENT DOCUMENTS

| | | | | |
|---|---|---|---|---|
| 3,123,909 | A * | 3/1964 | Dorst | 72/339 |
| 6,120,871 | A | 9/2000 | De Biase | |
| 6,349,662 | B1 * | 2/2002 | Limansky et al. | 114/219 |
| 6,371,040 | B1 * | 4/2002 | Hemphill et al. | 114/219 |
| 7,051,667 | B2 * | 5/2006 | Scotti | 114/219 |
| 7,517,001 | B1 * | 4/2009 | Goldbaum | 296/128 |
| 7,685,956 | B2 * | 3/2010 | Hynes | 114/219 |

FOREIGN PATENT DOCUMENTS

| | | |
|---|---|---|
| DE | 1118040 | 11/1961 |
| EP | 1 586 500 | 10/2005 |
| EP | 1 990 269 | 11/2008 |
| FR | 1151730 | 2/1958 |

* cited by examiner

*Primary Examiner* — Daniel V Venne
(74) *Attorney, Agent, or Firm* — Jacobson Holman, PLLC.

(57) ABSTRACT

A fender for boats provides a rolled profile with an open section, consisting of an external shell connected at its ends to two straight parallel supporting and containing strips which converge towards the center of the shell without meeting and are capable of bearing against the side of the boat, the rolled profile being filled internally with a core of PVC.

2 Claims, 7 Drawing Sheets

FENDER FOR A BOAT, IN STEEL WITH PVC CORE

This is a national stage of PCT/EP09/053389 filed Mar. 23, 2009 and published in English, which claims the priority of Italian number MI 2008A 002244 filed Dec. 17, 2008, hereby incorporated by reference.

FIELD OF THE INVENTION

The present invention concerns a fender for a boat, in steel with a PVC core.

BACKGROUND OF THE INVENTION

Fenders for boats are known consisting of a half-round in stainless steel, formed from rolled strip, countersunk and pierced with a blanking tool, laid over a PVC base which has the task of cushioning and protecting the gel coat (polyester resin-based substance used to coat fibreglass to make it impervious) of the boat from the metal.

The advantages of this solution are the very low weight and cost, while the disadvantages are the result of the impossibility of bending the half-round manually over the perimeter of the boat because it yields and deforms (torsion) in the area of the fixing holes.

Applying this type of fender necessarily requires radial bending with costly equipment. Furthermore it is necessary to make profiles to measure, i.e. varying according to the type of curve and type of boat.

Finally, a profile made in accordance with this solution is fairly vulnerable to impact.

A second solution is also known which provides for a half-round (therefore solid) section in drilled steel obtained by forging and rolling, with various heat treatments, therefore forging and countersinking with a drill, besides final polishing.

Said solution entails very high costs and substantial weight above the boat's centre of gravity; it is easier to fit manually but there remains the risk that it will give way at the drilling points (because of the weight).

SUMMARY OF THE INVENTION

The object of the present invention is the creation of a fender for boats, of low cost, simple to make and fit, and ensuring a high level of protection from knocks, without deformation.

In accordance with the invention this object is achieved with a fender for a boat, comprising a rolled section of steel with an open section, consisting of a curved portion connected at two ends of the curved portion to two straight strips, wherein said rolled section is of C-shape and said curved portion is connected to said two straight strips by two rounded portions, said two straight strips being converging towards each other without meeting, said two straight strips encompassing and containing a core of PVC, said rolled section being filled internally with a core of PVC and said rolled section being fixed to a curved side of the boat, said two straight strips each having an outboard face, said outboard face bearing against a base of PVC, said base of PVC being interposed between said outboard face and the curved side of the boat, said rolled section being fixed to the curved side of the boat, the outboard face bearing against a surface of the base of PVC having two ends consisting of rounded concavities forming a main concavity housing said two straight strips and said two rounded portions of the fender, said rounded portions of the fender interacting with said rounded concavities of the base of PVC, and said rolled section comprising a plurality of holes for screws for fixing the rolled section by said screws penetrating the core of PVC and engaging with the curved side of the boat by passing between ends of said two straight strips.

BRIEF DESCRIPTION OF THE DRAWINGS

These and other characteristics of the present invention will be made more clearly evident from the following detailed description of an example of its practical embodiment which is illustrated without limiting effect in the attached drawings, in which.

DETAILED DESCRIPTION OF THE PREFERRED EMBODIMENTS

Figure 1:
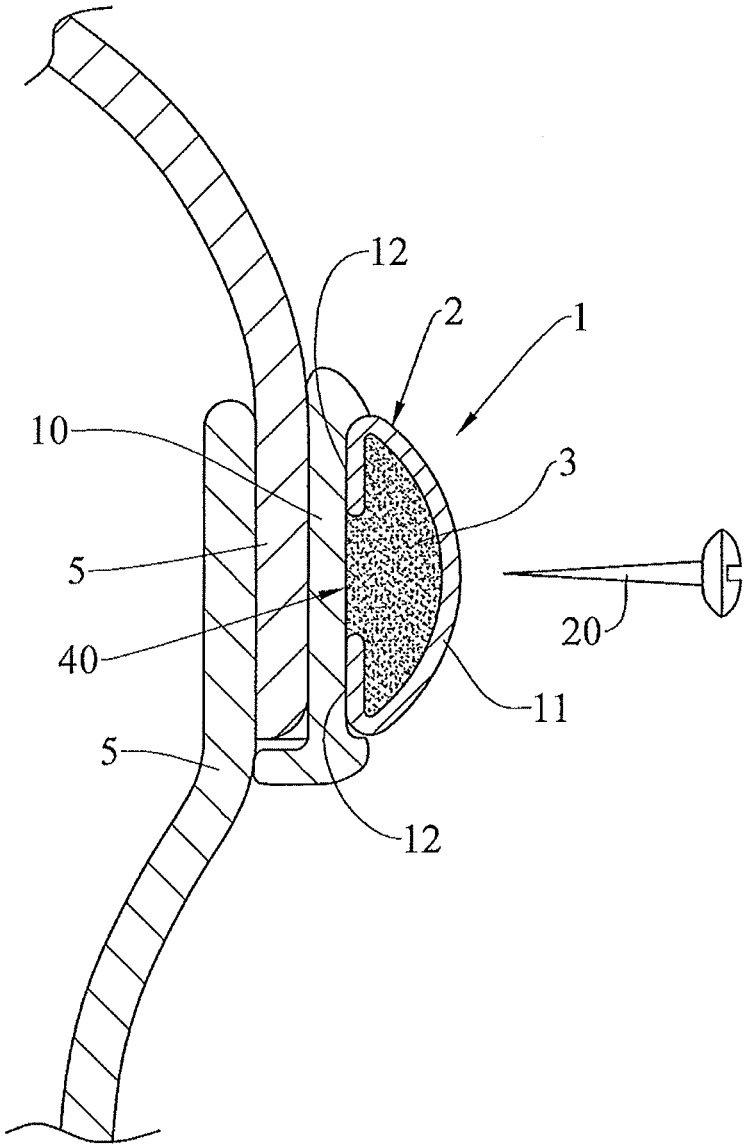
FIG. 1 shows a view in vertical section of a fender fitted according to the present invention.
Figure 2:
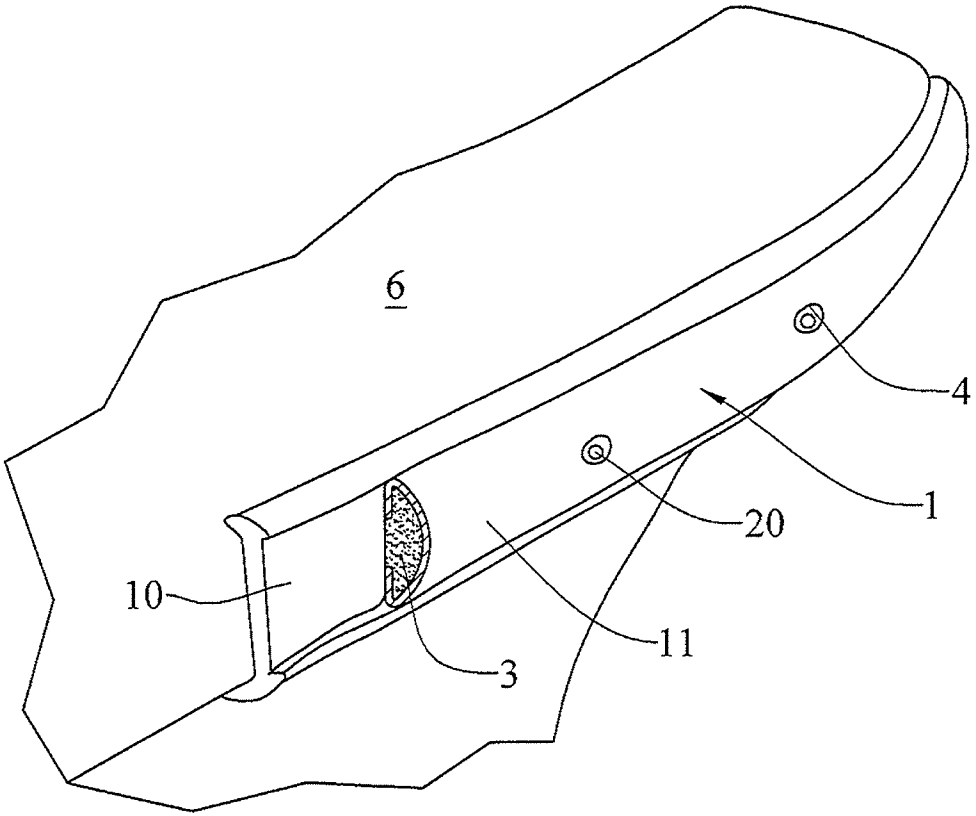
FIG. 2 shows a perspective view of the fitted fender.

The drawings show a fender 1 for a boat 6 consisting of a rolled profile 2 with a "C"-shaped open section in stainless steel filled with a core 3 in rigid PVC (polyvinyl chloride).

The fender 1 comprises a plurality of countersunk holes 4 for fixing the fender 1 to the side 5 of the boat 6.

Figure 3:
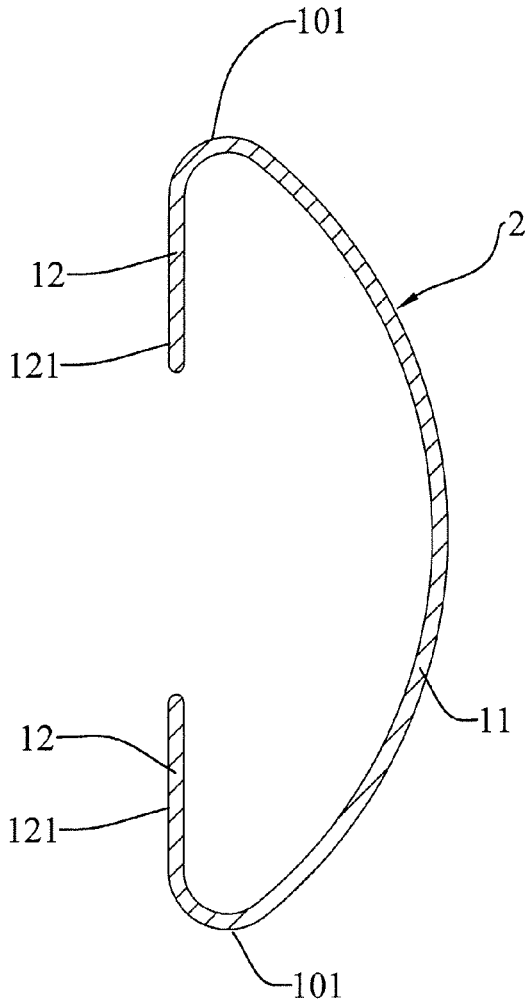
FIG. 3 shows a view in vertical section of the shell folded from stainless steel strip.
Figure 4:
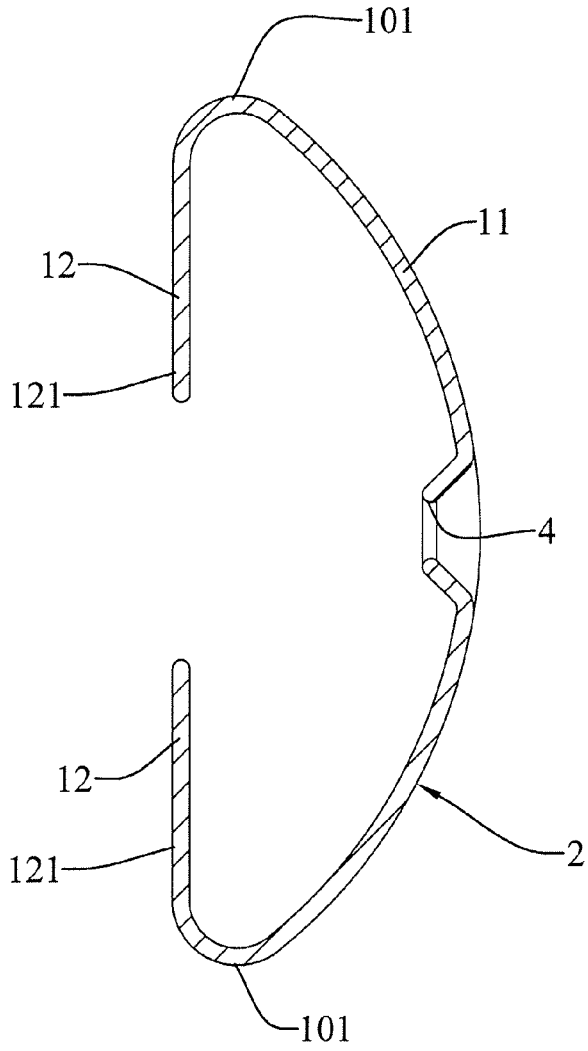
FIG. 4 shows a view in vertical section of the shell shown in FIG. 3, pierced and blanked.
Figure 5:
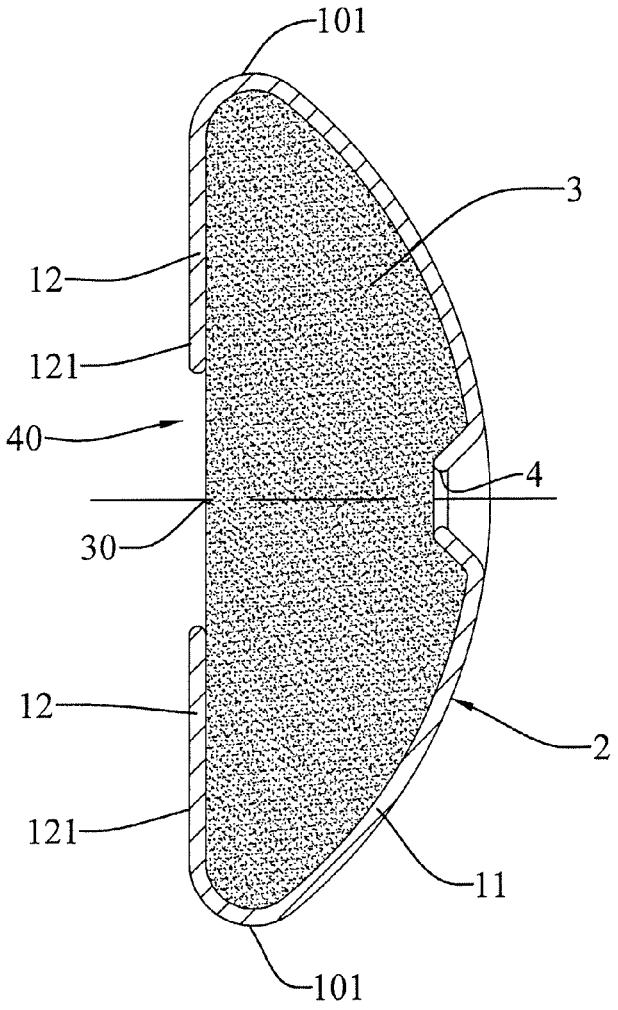
FIG. 5 shows a view in vertical section of the shell shown in FIG. 4 filled with PVC.
Figure 6:
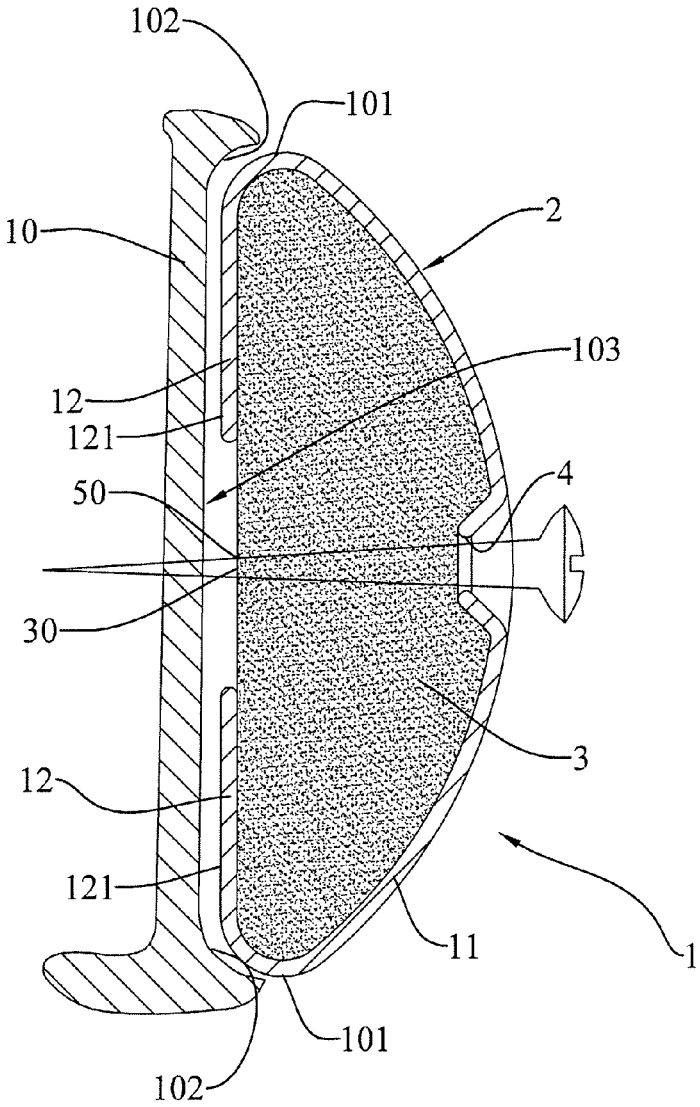
FIG. 6 shows a view in vertical section of the finished fender fitted to the side of the boat.
Figure 7:
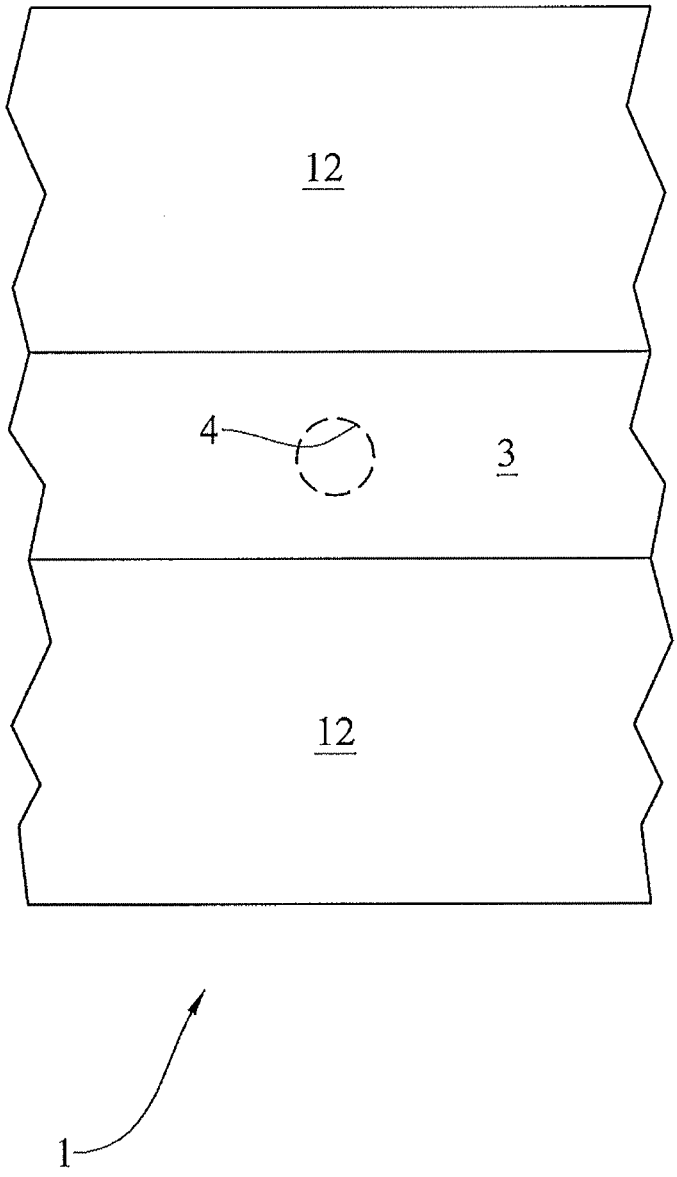
FIG. 7 shows a lateral view from the left of a stretch of the finished fender.

The "C"-shaped profile 2 of the fender according to the present invention is obtained through rolling by folding a strip of stainless steel (for example 316L of 1 mm thickness, FIG. 3), and subsequently piercing it to obtain the countersunk holes 4 for fixing screws 20 (for example every 25 cm, FIG. 4).

The profile 2 is then filled by extrusion with the core 3 in PVC (for example vinyl chloride with hardness 100 Shore).

Finally, the finished fender 1 is fixed to the side 5 of the boat with the interposition of a base 10 in PVC (for example vinyl chloride with hardness 83 Shore), making the screws 20 penetrate into the core 3 to form through holes 50.

More particularly, it should be noted that the profile 2 is made up of a half-round portion or shell 11 connected at its ends by two rounded portions 101 to two parallel straight strips 12 for bearing against the side of the boat 5, which converge towards the centre 30 of the shell but do not, however, close the section of the profile 2. Said two straight strips 12, encompassing and containing said core 3 of PVC, each has an outboard face 121, said outboard face 121 bearing against the base 10 of PVC. The base 10 of PVC has two ends consisting of rounded concavities 102 forming a main concavity 103 housing said two straight strips 12 and said two rounded portions 101 of the fender 1. Said rounded portions 101 of the fender 1 interact with said rounded concavities 102 of the base 10 of PVC.

The straight strips 12 perform an essential role because they allow the core 3 to be effectively surrounded by containing it, and they constitute the surface of fender 1 which bears against the base 10.

The straight strips 12 each have a length which is about a third of the length of the shell of the fender (see the proportions shown in FIGS. 3-6). Space must however be left for the fixing screw 20 to pass through.

They also enable torsional deformation to be prevented at the fitting stage, and allow the fender 1 to be manually bent along the perimeter of the boat, without being affected by the holes for the screws and without the use of machines for bending profiles.

As a consequence, a fender 1 is obtained which is economical, light (PVC core), easy to fit (without deformation) and robust (profile 2 in stainless steel).

The invention claimed is:

1. A fender for a boat comprising a rolled section of steel with an open section, consisting of a curved portion connected at two ends of the curved portion to two straight strips, wherein said rolled section is of C-shape and said curved portion is connected to said two straight strips by two rounded portions, said two straight strips being converging towards each other without meeting, said two straight strips encompassing and containing a core of PVC, said rolled section being filled internally with a core of PVC and said rolled section being fixed to a curved side of the boat, said two straight strips each having an outboard face, said outboard face bearing against a base of PVC, said base of PVC being interposed between said outboard face and the curved side of the boat, said rolled section being fixed to the curved side of the boat, the outboard face bearing against a surface of the base of PVC having two ends consisting of rounded concavities forming a main concavity housing said two straight strips and said two rounded portions of the fender, said rounded portions of the fender interacting with said rounded concavities of the base of PVC, and said rolled section comprising a plurality of holes for screws for fixing the rolled section by said screws penetrating the core of PVC and engaging with the curved side of the boat by passing between ends of said two straight strips.

2. The fender according to claim 1, wherein width of a cross section of each said two straight strips being a third of width of cross section of the curved portion of said rolled section.

* * * * *